United States Patent [19]

Dwinell

[11] 4,117,949

[45] Oct. 3, 1978

[54] THREADED CLOSURE

[75] Inventor: Davis B. Dwinell, Warren, N.J.

[73] Assignee: American Flange & Manufacturing Co. Inc., Linden, N.J.

[21] Appl. No.: 643,488

[22] Filed: Dec. 22, 1975

[51] Int. Cl.[2] ..... B65D 53/00

[52] U.S. Cl. ..... 220/304; 285/203; 285/204; 285/355

[58] Field of Search ..... 220/288, 378, 304; 215/341; 277/207 A; 285/204, 171, 220, 355, 203

[56] References Cited

U.S. PATENT DOCUMENTS

| | | | |
|---|---|---|---|
| 323,834 | 8/1885 | Turner | 285/171 |
| 500,412 | 6/1893 | McIntyre | 285/171 |
| 817,100 | 4/1906 | Bergman | 220/304 |
| 1,226,921 | 5/1917 | Stewart | 285/355 |
| 1,820,192 | 8/1931 | Hothersall | 220/304 |
| 1,915,309 | 6/1933 | Grosser | 220/378 |
| 2,187,503 | 1/1940 | Sheridan | 285/204 |
| 2,311,983 | 2/1943 | Gora | 215/341 |
| 2,445,802 | 7/1948 | Robinson | 285/203 |
| 2,471,716 | 5/1949 | Bell | 285/204 |
| 2,553,340 | 5/1951 | Smith | 285/355 |
| 2,675,142 | 4/1954 | Spayd | 220/304 |
| 3,101,207 | 8/1963 | Pavel et al. | 285/355 |
| 3,203,576 | 8/1965 | Wout et al. | 220/304 |
| 3,208,775 | 9/1965 | Stap et al. | 220/378 |
| 3,265,107 | 8/1966 | Glicksman | 285/220 |
| 3,438,530 | 4/1969 | Wallace | 215/341 |

*Primary Examiner*—William Price
*Assistant Examiner*—Allan N. Shoap

[57] ABSTRACT

A liquid tight closure for containers comprising a threaded neck secured about a suitably formed opening in a container wall section. An annular sealing gasket is formed in situ on the exposed surface of the terminal thread area remote from the neck mouth. A closing member threadedly engages the container opening neck with the starting thread area of the closing member in sealing engagement with the neck gasket thereby sealing off the thread engagement upon full seating of the closing member.

1 Claim, 5 Drawing Figures

THREADED CLOSURE

BACKGROUND OF THE INVENTION

In the packaging of liquid products in containers fitted with threaded metal closures, a need commonly arises for protecting the thread area against exposure to the packaged product. This need stems in part from the susceptibility to damage at the interengaged threaded surfaces due to product attack and in part from the adhesive character of certain products which penetrate the interengaged threaded surfaces making thread disengagement difficult.

Those prior art metal closure concepts, designed to provide a liquid tight seal at the inner or terminal end of the thread interengagement, have lacked sufficient practicality to warrant commercial exploitation. For example, one known concept employs some type of protruding seat for supporting a gasket at the terminal end of the opening thread against which the leading portion of the closure member seals. Such arrangements, however, are costly to produce and do not readily lend themselves to accepted manufacturing practices. Another approach is to include an additional separately attachable part in the closure construction to perform the above described thread gasketing function. This arrangement is similarly undesirable from a cost standpoint.

SUMMARY OF THE INVENTION

The instant invention, as hereinafter disclosed, effectively provides for sealing off the closure thread area against product exposure in a unique manner which circumvents the problems heretofore encountered. This has been accomplished by forming an annular resilient sealing gasket in situ on the terminal or inner thread portion of the closure receiving member so as to protrude radially beyond the thread crest. A closure member is then applied to the receiving member whereupon full thread engagement brings a leading surface of the closure member in sealing contact with the thread gasket. As a result, the relatively soft sealing gasket is wedged between the mating threaded surfaces effectively closing off any liquid access to the closure thread area. The relatively fragile thread engagement area of the closure thus remains protected against any potential deleterious effect brought on by product exposure.

It is, accordingly, a primary object of the invention to provide a new and improved threaded metal container closure for use with chemically active liquid product.

Another object is to provide a container closure construction having a new and improved gasketing arrangement for protecting the closure thread area against either internal product exposure or external contamination during shipment and storage.

A further object is to provide a new and improved threaded closure construction having a sealing gasket formed in situ to seal off the interengaging threaded surfaces of the closure against access by the packaged product.

Other and more detailed objects will in part be obvious and in part pointed out as the description of the invention taken in conjunction with the accompanying drawing proceeds.

Figure 1:
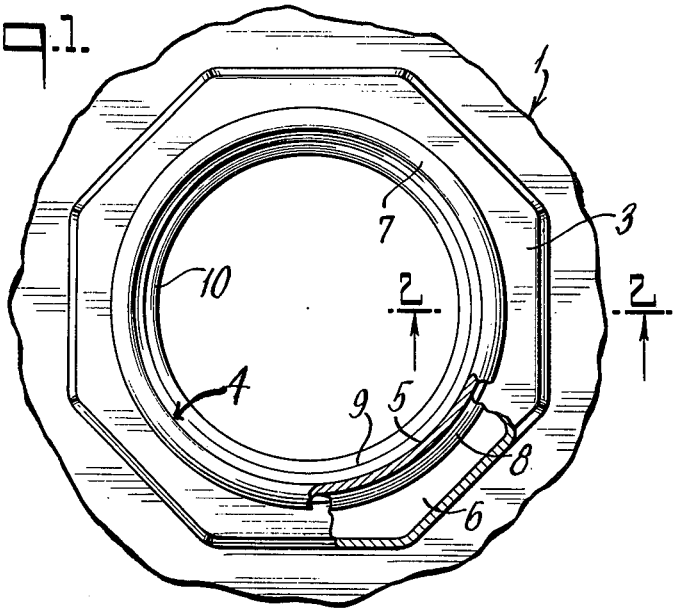
FIG. 1 is a top plan view of a closure flange inserted within a container wall with a fragment broken away and embodying the invention.
Figure 2:
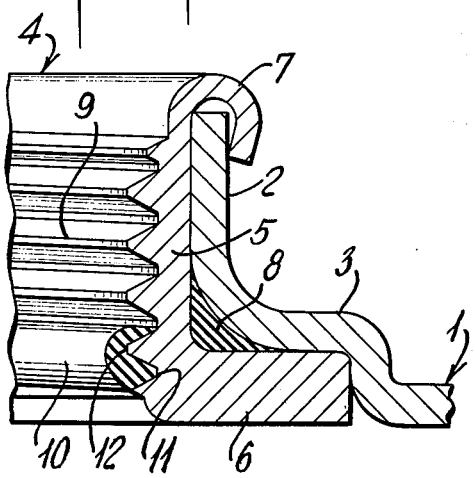
FIG. 2 is a view taken along lines 2—2 in FIG. 1 and looking in the direction of the arrows.

A section of a container wall 1 is shown in FIG. 1 provided with an opening surrounded by an upstanding neck 2 extending upwardly from an octagonally shaped embossment 3. A metal closure flange 4 is inserted within the container wall opening, clearly seen in FIG. 2, having an upstanding cylindrical neck 5 surrounded at its lower end by an octagonally shaped base 6 and nested within the container wall embossment 3. The upper end portion of the closure flange 4 has a radially outwardly curled bead 7 which is engaged over the upper end of the container wall neck 2 permanently locking the flange in position. A rubber gasket 8 surrounds the flange neck above the base 6 so as to seal off any leakage path between the flange and the surrounding container wall.

An internal screw thread 9 is formed along the interior surface of the flange neck 5 extending from the bead 7 to the base 6 leaving an open unobstructed threaded passage through the flange. An annular band of semi-liquid gasketing compound is applied to the lower portion of the thread 9 which, upon curing at an elevated temperature, forms a resilient sealing gasket 10. As clearly seen in FIG. 2, the gasket 10 is formed in situ in a continuous zone on the exposed surfaces of the last full turn of thread adjacent the flange base. The gasket 10 completely covers the screw thread extending into the thread root 11 and adhering to the thread crest 12 and thread flank surfaces contacted. In addition, the volume of the gasket 10 is such that it protrudes radially beyond the thread crest 12 forming a slight resilient constriction of the threaded neck passage.

Figure 3:
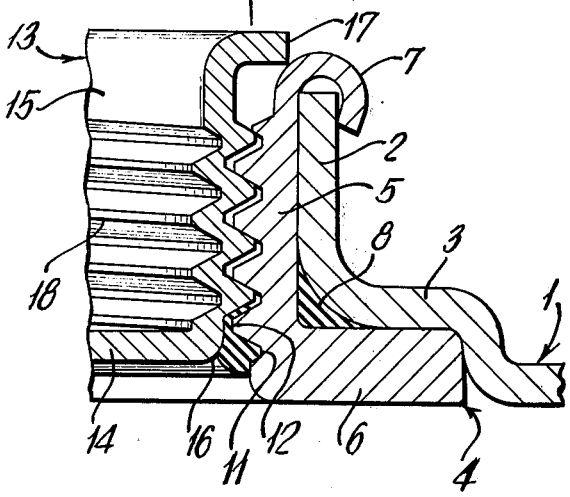
FIG. 3 is a view similar to FIG. 2 and showing a closure plug threadedly engaging the flange.

A closure plug 13 is shown in FIG. 3 in threaded engagement with the flange 4 having an end wall 14 surrounded by a cylindrical sidewall 15 joined to the end wall by a radiused corner portion 16. The plug wall 15 terminates at its upper end in a circumferentially extending lip 17 and is further provided with a screw thread 18 extending from the corner portion 16 to a position spaced below the lip 17. The unthreaded portion of the plug sidewall directly under the lip 17 can, if desired, serve as a seat for an additional gasket, not shown.

Upon full threaded engagement of the closure plug 13 within the flange neck 5, it can be readily seen in FIG. 3 how the plug bottom corner 16 contacts the annular sealing gasket 10 causing the gasket to be tightly squeezed between the lowermost interengaged threaded surfaces of the plug and flange. The gasket portion which is tightly compressed between the flange thread crest 12 and the opposing plug surfaces, effectively seals off any liquid passage between the two closure members. Moreover, the positioning of the sealing gasket at the point of thread engagement remote from the dispensing mouth of the closure, seals off the area of thread engagement against exposure to the contained liquid product. It should also be noted that a stop means is provided by engagement of the plug lip 17 against the flange bead 7 limiting further travel of the plug which might otherwise damage the gasket 10. With the integrity of the gasket thus safeguarded, repeated opening and closing of the closure can be carried out without impairing the effectiveness of the gasket.

Figure 4:
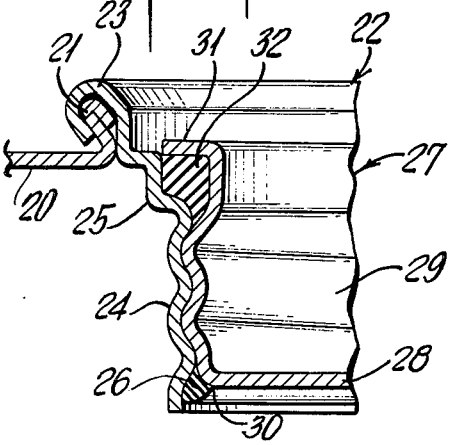
FIG. 4 is a partial cross-sectional view of a modified form of the invention.

A modified form of the invention is shown in FIG. 4 wherein a container wall 20 is provided with an opening surrounded by an upstanding doubled over rim 21. A lightweight metal closure flange 22 is inserted within the container opening and provided with a downwardly opening circumferential channel 23 at its upper end which is tightly crimped over the upstanding opening rim 21. The flange 22 further comprises a downwardly extending threaded neck 24 joined to the channel 23 by a gasket seat portion 25. An annular sealing gasket 26 is formed in situ about the lower end of the threaded neck 24 so as to protrude radially inwardly beyond the neck thread. A closure plug 27 is engaged within the flange neck 24 and provided with an end wall 28 and joined thereto by a radiused corner 30 surrounded by a threaded sidewall 29. The uppermost end of the sidewall 29 terminates in a circumferentially extending lip 31. As in the principal embodiment of the invention, full threaded engagement of the plug 27 with the flange neck 24 causes the plug bottom corner 30 to embed itself in the gasket 26 which is accordingly wedged between the adjacent flange and plug threaded surfaces. At the same time the plug lip 31 contacts the flange limiting further thread travel once the thread area is sealed off. As an additional safeguard against leakage, a conventional plug gasket may also be provided as indicated at 32 for sealing engagement on the flange gasket seat 25.

Figure 5:
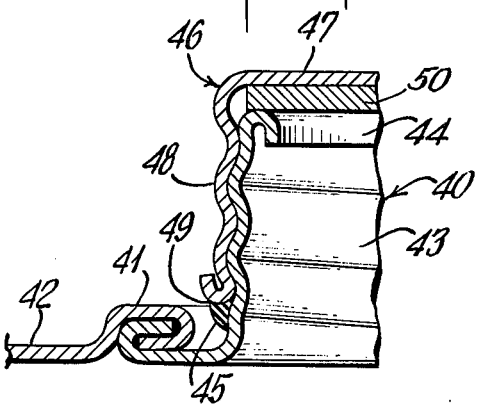
FIG. 5 is a partial cross-sectional view of a further modified form of the invention.

A further modified form of the invention is shown in FIG. 5 wherein a lightweight metal nozzle 40 is seamed as indicated at 41 within an opening in a container wall 42. The nozzle is formed with an upstanding threaded neck 43 terminating in an inward curl 44. A sealing gasket 45 is formed in situ on the exterior surface of the nozzle at the base of the neck thread. A closure cap 46 is fitted on the nozzle 40 provided with an end wall 47 surrounded by a depending threaded sidewall 48 which terminates at its lowermost end in an outwardly formed bead 49. A liner 50 may be applied to the cap if desired. In this form of the invention, full thread engagement of the cap 46 with the nozzle 40 embeds the cap bead 49 in the nozzle gasket 45 closing off any entry by exterior contaminants to the closure thread area. Once again downward travel of the closure cap is controlled by contact with the curl 44.

From the foregoing, it can be seen that an improved closure gasketing construction has been brought forth for effectively sealing off the interengaged threaded surfaces of a metal closure so as to prevent access thereto from either the inside or the outside of the container during shipment and storage. It should be noted that further variations in the closure construction could be employed utilizing different types of threaded flanges, nozzles, and threaded container necks or by varying the positioning of the sealing gasket relative to the neck threads.

Still other changes in or modifications of the construction and different embodiments of the invention would suggest themselves to those skilled in the art and could be made without departing from the spirit or scope of the invention. It is, accordingly, intended that all matter contained in the above description or shown in the accompanying drawing shall be interpreted as being illustrative and not in a limiting sense.

I claim:

1. Container closure construction comprising a closure receiving member having a cylindrical neck defining a fluid passageway with a dispensing opening at the uppermost end thereof adapted to communicate with the exterior of a container, means formed at the upper end of said neck for securing said closure receiving member about a container wall opening, a first screw thread formation adjacent said means extending along the entire length of said neck, an unthreaded annular resilient sealing gasket formed in situ on the exposed surface of said neck thread in a relatively narrow zone, said gasket completely filling the thread portion located at said narrow zone and protruding radially inwardly of the thread crest and root of said thread portion into said fluid passageway, said narrow zone being located at a position on a lower portion of said neck remote from said dispensing opening, a closure member having an end wall surrounded by a cylindrical sidewall extending upwardly from said wall, said sidewall having a second screw thread formation in direct surface to surface threaded engagement with said neck, an annular gasket engaging surface on said closure member at the juncture of said end wall and said sidewall below said second screw thread formation in sealing contact with said sealing gasket so as to protect the threads of said sealing engagement located above said sealing gasket from exposure to the product to be stored in the container, and means at the upper end of said neck cooperating with means on said sidewall for limiting the axial extent of said threaded engagement at said point of sealing contact.

* * * * *